US009732456B2

(12) United States Patent
Magnusson

(10) Patent No.: US 9,732,456 B2
(45) Date of Patent: Aug. 15, 2017

(54) WASHING MACHINE HAVING A WASHING BAG

(75) Inventor: Fredrik Magnusson, Saltsjo-Boo (SE)

(73) Assignee: Roderinno AB, Saltsjö-Boo (SE)

( * ) Notice: Subject to any disclaimer, the term of this patent is extended or adjusted under 35 U.S.C. 154(b) by 0 days.

(21) Appl. No.: 13/880,565

(22) PCT Filed: Oct. 27, 2011

(86) PCT No.: PCT/SE2011/051278

§ 371 (c)(1),
(2), (4) Date: Apr. 19, 2013

(87) PCT Pub. No.: WO2012/057688

PCT Pub. Date: May 3, 2012

(65) Prior Publication Data

US 2013/0205513 A1 Aug. 15, 2013

(30) Foreign Application Priority Data

Oct. 27, 2010 (SE) ..... 1051115

(51) Int. Cl.
*D06F 15/02* (2006.01)
*A45C 13/00* (2006.01)
(Continued)

(52) U.S. Cl.
CPC ..... *D06F 15/02* (2013.01); *A45C 13/008* (2013.01); *D06F 1/00* (2013.01); *D06F 17/02* (2013.01); *D06F 35/00* (2013.01); *D06F 35/006* (2013.01)

(58) Field of Classification Search
CPC . D06F 1/00; D06F 15/02; D06F 17/02; D06F 35/00; D06F 35/006; A45C 13/008
See application file for complete search history.

(56) References Cited

U.S. PATENT DOCUMENTS 2,472,682 A * 6/1949 Rand ..... D06F 47/06 68/21
2,596,791 A 5/1952 Rand
(Continued)

FOREIGN PATENT DOCUMENTS

CN 2409223 Y 12/2000
CN 201245774 Y 5/2009
(Continued)

OTHER PUBLICATIONS

European Patent Application No. EP11836727.5 , "Extended European Search Report", Apr. 16, 2014, 3 pages.
(Continued)

*Primary Examiner* — Karla Moore
*Assistant Examiner* — Tinsae Ayalew
(74) *Attorney, Agent, or Firm* — Kilpatrick Townsend & Stockton LLP

(57) ABSTRACT

Washing machine for the washing of laundry such as clothes and textiles, which washing machine has a main part that comprises: an inlet, for supplying washing water, an outlet, for disposal of washing water, a pump, in order to pump the washing water, a connection unit for fluid tight connection of a washing bag to the main part. The washing bag has fluid tight walls and is removably connectable to the connection unit of the main part, wherein the pump is arranged to pump water and air from the washing bag in order to create a certain negative pressure inside it with respect to the surrounding atmospheric pressure and by that emptying it of washing water.

9 Claims, 1 Drawing Sheet

Figure 2:
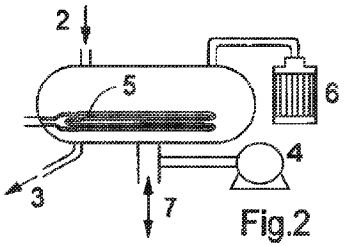

(51) Int. Cl.

| | |
|---|---|
| ***D06F 1/00*** | (2006.01) |
| ***D06F 17/02*** | (2006.01) |
| ***D06F 35/00*** | (2006.01) |

(56) References Cited

U.S. PATENT DOCUMENTS

| | | | | | |
|---|---|---|---|---|---|
| 2,655,803 | A | * | 10/1953 | Richardson | 68/15 |
| 2,826,059 | A | * | 3/1958 | Sibbald | D06F 47/06 68/242 |
| 3,318,117 | A | * | 5/1967 | Padial | 68/21 |
| 3,503,085 | A | | 3/1970 | Groebli | |
| 4,305,265 | A | | 12/1981 | Burgas | |
| 6,219,871 | B1 | * | 4/2001 | Frederick et al. | 8/159 |
| 2005/0166334 | A1 | * | 8/2005 | Clouser | 8/159 |

FOREIGN PATENT DOCUMENTS

| | | | | | |
|---|---|---|---|---|---|
| DE | 2650509 | | | 5/1978 | |
| GB | 2153395 | A | * | 8/1985 | D06B 3/201 |
| GB | 2378712 | A | | 2/2003 | |
| JP | 2010088840 | A | | 4/2010 | |

OTHER PUBLICATIONS

International Patent Application No. PCT/SE2011/051278, International Search Report and Written Opinion mailed Feb. 15, 2012 (10 pages).

Chinese Patent Application No. 201180052060.2, First Office Action mailed Feb. 4, 2015, 10 pages.

* cited by examiner

WASHING MACHINE HAVING A WASHING BAG

PRIOR RELATED APPLICATIONS

The present application is a national phase of PCT/SE2011/051278, filed Oct. 27, 2011, which claims the benefit of priority to Swedish Patent Application No. 1051115-2, filed Oct. 27, 2010, each of which is incorporated herein by reference in its entirety.

FIELD OF THE INVENTION

The invention relates to a washing machine and in particular to a washing machine in which the laundry is washed inside a bag that is arranged in a fluid tight manner on the washing machine. The invention also relates to a washing method.

BACKGROUND OF THE INVENTION

Conventional washing machines of today are usually relatively voluminous, usually of a certain standard measure. A washing machine washes laundry, such as clothes, by wetting them, drying them, wetting them again etc. until the laundry is clean. In order to accomplish this laundering most of today's washing machines comprise a cylindrical drum in which the laundry may be alternately soaked and dried without having to be transferred between different chambers. The latest development in the laundry business has apart from the development of advanced washing programmes and informative user interfaces been all about minimisation of the consumption of energy and water, and to some extent the drying effect, whereby the washing machines of today are both more energy efficient and consume less water than what was the case only 10 years ago. Further, the spin-drying efficiency has been increased such that the washed laundry will be drier than what has been possible in the past. This is advantageous since it implies that less energy needs to be consumed at the subsequent drying of the laundry. On the other hand the washing machines are just as voluminous as they were 50 years ago.

PRIOR ART

There are however other ways of washing laundry. An example is shown in the laid open patent application GB 2 153 395, in which the laundry is washed in a bag inside a pressure chamber. In the middle of the bag there is a perforated column, through which water passes in and out and towards which the laundry is pressed when the bags are emptied of water. Every time the water is pressed out of the bag the laundry is kneaded towards the column. Due to the fact that the washing machine comprises a pressure chamber it is however just as voluminous as any other conventional washing machine.

A less voluminous washing machine is shown in the laid open patent application GB 2 378 712, which relates to a travel washing machine. This "washing machine" is driven by hand power in that the operator presses a volume in which the laundry is located such that the water in this volume is forced out to a surrounding volume. When the pressure decreases in the first volume the water flows back into this volume. This process is repeated a number of times such that the laundry is washed.

Yet another washing machine is disclosed in U.S. Pat. No. 2,596,791. In this washing machine the laundry is washed in a washing space that is delimited by a membrane inside a washing bag. The laundry is pressed by means of negative pressure that is applied in the washing volume between the bag and the membrane. A combined inlet and outlet is arranged in the lowest part of the bag. A separate washing device comprising e.g. water supply and a pump is separately arranged to be connected to the inlet and outlet on the washing bag where it is has been hung.

Today there is no non-voluminous washing machine that is not driven by hand power and that washes laundry in a satisfying manner.

SHORT DESCRIPTION OF THE INVENTION

An object of the invention is to provide a washing machine that is not voluminous, that washes laundry in a satisfying manner without the use of hand power and that is uncomplicated to mount and to connect for washing purposes.

The invention relates to a washing machine that comprises an inlet and outlet for water and possibly a heating unit in order to heat water. In contrast to conventional washing machines, the laundry is washed in an especially adapted washing bag inside the washing machine. Preferably the user has different washing bags (one for white laundry, one for 40 degrees centigrade, etc.), which also may be used for storage of dirty laundry, whereby the laundry may be sorted already when it is located for storage in the correct washing bag. The washing bags are hung on the washing machine by means of a suitable fluid tight connection. Subsequently, water is provided into the bag from the washing machine, which is heated to the desired temperature. The washing detergent may be provided directly to the bag or via a separate compartment in the washing machine to be distributed into the washing bag together with the water. After the water has been added to the bag the vacuum pump is activated. Firstly the pump is used to suck air from the washing bag, whereby the laundry is compressed and soaked in water. Gradually the water is sucked out, and the same water may be returned to the bag a couple of times before the water is exchanged and the cycle is repeated once again. When the water is sucked out a negative pressure is created in the washing bag and due to the created pressure difference inside and outside of the bag, the laundry is compressed by the walls of the washing bag, while washing water and air bubbles passes through them.

Specifically, the invention relates to a washing machine for the washing of laundry such as clothes and textiles, which washing machine comprises a main part and a washing bag in which the washing of the laundry takes place, wherein the main part comprises: an inlet, for supplying washing water, an outlet, for disposal of washing water, a pump, in order to pump the washing water, a connection unit for fluid tight connection of the washing bag to the main part. The washing bag has fluid tight walls and a connection part for fluid tight connection to the connection unit of the main part, whereby the connection unit of the main part is arranged to supply water from the inlet of the main part to the washing bag and to, by means of the pump, pump water and air out from the washing bag in order to create a negative pressure inside the washing bag with respect to the surrounding atmospheric pressure and by that emptying it of washing water, and whereby the washing bag is arranged to lead water to the connection part even when the inner walls are pressed towards each other.

An advantage of the invention is that only as much water as is needed to wet the laundry is needed, whereby the consumption of both water and energy may be minimised.

The walls of the bag are preferably relatively rigid and designed such that there will be no stoppage between them. For instance, they may be undulated where the first side has horizontal waves and the opposed side has vertical waves. Additionally, the bag has preferably a shape memory such that it will regain its original shape once the pressure has been balanced such that it is approximately as high outside of the bag as inside it.

Two further advantages of the invention include firstly that the washing machine does not comprise any voluminous element such as a pressure chamber or a cylinder drum, and secondly, that the actual washing volume is removable and may be used for sorting and storage of dirty laundry.

A further advantage is that the washing machine may be arranged on a wall such that the washing bag may be arranged under the same.

Further advantages of the invention will be apparent from the detailed description and the dependent claims.

SHORT DESCRIPTION OF THE DRAWINGS

Figure 4:
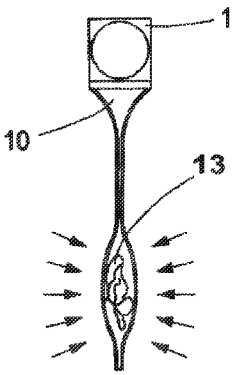
Figure 3:
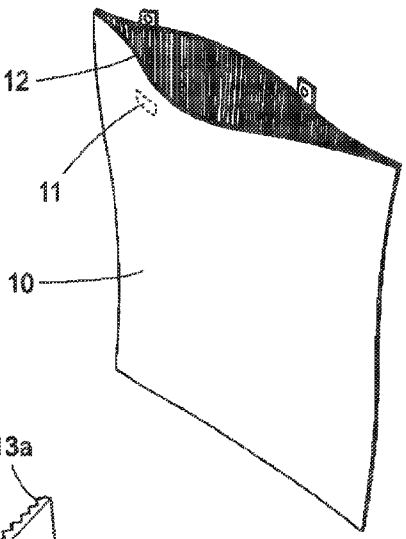
Figure 5:
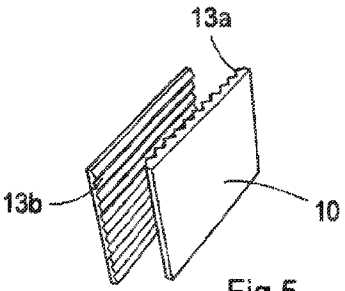
Figure 1:
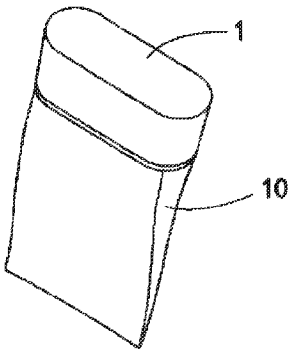

FIG. 1 shows an embodiment of the washing machine comprising a wall mounted main part with a connected washing bag, FIG. 2 shows a schematic illustration of the components in the wall mounted main part of FIG. 1, FIG. 3 shows an embodiment of a washing bag according to the invention, FIG. 4 shows a cross sectional view of the washing machine, at a point in time when water is sucked out of the bag and the laundry in the bag is compressed, and FIG. 5 shows a view of a portion of the washing bag shown in FIG. 3, from which the vertical and horizontal undulations of the opposed walls appear.

DETAILED DESCRIPTION OF THE SHOWN EMBODIMENT

A first embodiment of the washing machine according to the invention is shown in FIG. 1. The washing machine comprises a wall mounted main part 1 and a washing bag 10, which is removably connectable to the main part 1. In FIG. 2, the components of the main part 1 are schematically shown. The main part 1 comprises an inlet 2, for supplying clean washing water and an outlet 3, for disposal of used washing water. The main part 1 further comprises a pump 4, in order to pump the used washing water out of the washing bag 10. In order to supply clean water no pump is normally needed because the water will be provided from a pressurised and closed water system such as a public water supply system. The pump 4 may however advantageously be utilised to create a negative pressure in the connected washing bag 10. The higher the efficiency of the pump 4 is the more important the negative pressure that may be created in the washing bag 10 will be. The magnitude of the negative pressure ultimately governs how dry the laundry 13 may become subsequent to the washing. Hence, the pump 4 replaces the spin dryer of the conventionally used washing machine of today where the laundry 13 is washed and spin dried in a cylinder drum.

Preferably, the main part 1 comprises a heating unit 5 with which the water may be heated to the desired temperature regardless of the inlet temperature. The main part 1 should also include a small tank 6 in which the heating unit 5 may be arranged. The tank 6 makes it possible to re-utilise the washing water. Due to environmental friendly reasons it is advantageous that the laundry 13 is washed several times with the same water, because it saves both water and heating energy. Further, the washing efficiency is not drastically worsened because the same washing water is used several times, since the washing water very rarely is saturated in impurities. Hence, a prewash with a first water change is only necessary when very dirty laundry is to be washed. A water exchange should however always be made for the rinsing of the laundry 13.

For reasons concerning both the environment and the washing efficiency it is also advantageous if the tank 6 is heat isolated such that heat energy is saved between the different washing steps.

Preferably, the main part 1 of the washing machine comprises an electronic equipment (not shown) where a desired washing programme out of severable selectable washing programmes may be chosen. The washing programmes may e.g. control the washing temperature, number of soakings of the laundry 13, number of change of washing water, the dryness of the laundry 13 after the performed washing and other parameters that may be controlled on conventional washing machines. Preferably, there is a number pre-set washing programmes that may be chosen by means of a suitable interface on the main part 1. According to one embodiment the washing bag 10 comprises a unit 11, such as a transponder or a RFID (Radio Frequency Identity) that communicates to the electronic equipment which washing programme is desired for the laundry 13 in the washing bag 10. In such an embodiment it is suitable that the user has several different washing bags 10, e.g. one for white laundry, one for wool, one for laundry at 40° C., one for laundry at 60° C. etc., wherein the user may sort his laundry already when he puts them in the washing bags 10. When a washing bag 10 is full or when the user wants to wash he may simply connect the desired bag 10 to the main part 1, whereby a suitable washing programme is automatically set. To provide further flexibility or as a safety measure the interface of the electronic equipment may however be such arranged that the user is given information about which washing programme that is set to be used, whereby he may also have the possibility to change to another programme if desired.

Preferably, the main part 1 also comprises a compartment for dosage of washing detergent, which is located such that the water that is supplied to the washing bag 10 will pass and bring the washing detergent from it. It is however also possible to place the washing detergent directly inside the washing bag 10, wherein no such compartment is needed in the main part 1, unless both a prewash and a main wash is desired, since the exchange of water that would result in that case would require the washing bag 10 to be opened between the prewash and the main wash in order to provide the washing detergent.

A washing bag 10 that is to be used in the washing machine naturally needs to be specially designed in order for the washing to be performed in it. This is shown in FIG. 3. Most important is of course that it is fluid tight. Further, it needs to have a connection part 12 for fluid tight connection to the connection unit 7 of the main part 1 such that washing water may be transported in and out of the washing bag 10. Preferably, the washing bag 10 is removably connectable to the main part 1, as in the shown embodiment, but the washing bag 10 may also have an opening for entering and removal of laundry 13. In the shown embodiment, the connection part 12 and the opening are integrated in such a way that the opening of the washing bag 10 is connected to or such that it encloses the connection unit 7 on the main part 1 of the washing machine. According to another embodiment the opening of the washing bag 10 may instead be separated from the connection to the main part 1, wherein the washing bag 10 comprises both a separate opening with a fluid tight connection device such as a zipper or any other type of seal and a connection part 12.

The connection between the washing bag 10 and the main part 1 is only schematically shown in the figures. This is partly due to the fact that it may be arranged in a great variety of ways. It is however suitable to utilise the negative pressure that is created under the washing process to guarantee the seal between the washing bag 10 and the main part 1. A way of enabling a feasible connection of the washing bag 10 to the main part 1 is thus to provide the washing bag 10 with an elastic connection part 12 that may be threaded onto the connection unit 7 of the main part 1 and be fastened in a way that ensures that the washing bag 10 is held at place and that minimises leakage between the washing bag 10 and the connection unit 7. For example, the connection part 12 of the bag 10 includes a rubber rim or the like that fits tightly around the connection unit 7 of the main part 1 and that is sucked so as to form a fluid tight connection when the negative pressure is created in the washing bag 10. Subsequently, when the pump 4 empties the washing bag 10 of water and air the washing bag 10 will be tightly sucked to the connection unit 7 as long as it prior to that is sufficiently tight between the washing bag 10 and the connection unit 7.

Other parts of the inner walls of the washing bag 10 are provided with concavities- and/or convexities 13*a-b* in order for the walls not to get stuck towards each other without letting water and air pass when a negative pressure of a certain magnitude has been created inside the washing bag 10. In the shown embodiment in FIG. 5 the bag has two walls, which both are undulated in the form of waves, wherein the waves 13*a* on one of the walls run in a vertical direction and the waves 13*b* on the other wall run in a horizontal direction. An important aspect in this embodiment is that the waves are not parallel such that the walls do no lock towards each other to stop the flow of water and air between them. The undulated insides of the walls do not need to be orthogonal with respect to each other or directed in any particular direction. Further they do not have to include straight lines, e.g. the undulations of the walls may be comprised of curved counter directed undulations. There are however a wide variety of embodiments that are obvious for the skilled person. For instance it is possible to find available solutions among bathroom mats or vapour barriers.

An advantage of the concavities and/or convexities 13*a-b* of the inner walls is that they enable for the connection of the washing bag 10 to the washing machine maybe placed in the bag's upper part. This is an advantage because it implies that the washing machine, including the pump 4 and the water supply may be mounted on a wall and that the bag may be easily connected to the washing machine from below. Namely, if the walls are flat they will prevent the flow of fluid, which in turn implies that the connection to the washing machine has to be located in the lowermost part of the washing bag 10 in order to suck out all the water, because the gravitation brings the water downwards. If, on the other hand, the inner walls are provided with concavities and/or convexities such that both water and air to may be sucked upwards even when a negative pressure has been created in the washing bag. No undulations should be located near the washing bags 10 connection part 12 in order not to worsen the adhesion between the washing bag 10 and the main part 1 that is created by the negative pressure.

In an alternative embodiment the concavities and/or convexities may be formed of at least one separate fluid permeable inner wall, e.g. in the form of a fine-meshed net, that extends along at least one of the inner walls and guarantees that the inner walls will not be stuck to each other.

Another similar solution is to arrange fluid leading means adapted to convey water and air from the lower part of the bag to its upper part, and via the connection part further into the main part 1 of the washing machine. The fluid leading means may preferably extend along the inner wall and have openings in order to suck up water and air in the bottom of the bag. Preferably, the fluid leading means extends along the whole bottom in order to in the best possible way suck up all liquid that has gathered along the bottom. With a fluid leading means of this type a less powerful pump may be used because the liquid is sucked up from the bottom of the bag, wherein use is made of the fact that the liquid is brought downwards by gravity.

It is advantageous if the walls do not have concavities and/or convexities with sharp edges since these could damage the laundry 13 and could undesirably assist to guide the fluid along the walls and not through the laundry 13. The washing effect is on the contrary achieved when the fluid flows through the laundry 13, preferably at the same time as they are kneaded by the walls as they are being sucked towards each other.

The washing bag 10 should also contain a heat isolating layer in order to minimise the portion of heat energy that is emitted to the surrounding. This is important both for energy saving and wash efficiency reason. Further it is advantageous if the bag has a shape memory such that it regains its original shape after that the pressure has been balanced such that it is substantially the same inside and outside of the bag. This may e.g. be achieved in that the bag is made in a rigid material, or in that it is provided with rigidities, e.g. at its edges.

The invention also relates to a method for washing laundry 13 such as clothes and textiles, which is shown in FIG. 4. According to this method a step consists of placing the laundry 13 in a washing bag 10 of the type described above. Another step consists of connecting the washing bag 10 to an inlet 2 for supplying clean washing water, an outlet 3, for disposal of used washing water, and a pump 4, for pumping the clean and/or used washing water in and out of the washing bag 10. In the shown embodiment the laundry 13 is placed in the washing bag 10 before it is connected, but in an alternate embodiment it is also possible to first connect the bag and subsequently fill it with laundry. After these steps clean washing water is supplied to the bag and any air in the bag is pumped out such that the laundry 13 is soaked and compressed by the walls of the bag. Once the laundry 13 is soaked it is possible to pump out the washing water from the bag, wherein a certain negative pressure is created in the bag, and wherein the laundry 13 is further compressed by the atmospheric pressure outside the bag. As the water is being pumped out the laundry 13 in the bag is kneaded towards each other.

The washing becomes efficient thanks to the combination of pressure towards the laundry 13 and the movement of the washing water and air bubbles, which penetrate in between the fibres of the laundry 13 and deeply remove impurities. Further, the laundry 13 is kneaded by the walls of the washing bag 10 and towards each other which increases the washing efficiency. Once the washing water has been sucked out to the desired degree the rinsing water is supplied to the washing bag. The purpose of the rinsing water is e.g. to perform a final cleaning of the laundry 13 and to remove any remainders of the washing detergent. Further, rinsing fluid and/or fabric softener, which softens and/or gives the laundry 13 a pleasant fragrance, may be supplied together with the rinsing water.

The rinsing water is removed from the washing machine in the same manner as the washing water. Hence, any air that is left in the bag is pumped out such that the laundry 13 is compressed and soaked, and subsequently the rinsing water is pumped out from the bag, wherein a certain negative pressure is created in the bag, and wherein the laundry 13 is compressed by the atmospheric pressure outside of the bag. Preferably, the electronic equipment of the main part 1 comprises a control with which it is possible to control the dryness of the laundry 13. The dryness may also be one of the parameters that are controlled by means of the different washing programmes, such that every washing programmes is connected to a certain dryness, which naturally also may be the same for several different washing programmes. The dryness is a function of the work of the pump and the created negative pressure inside the washing bag 10. Hence, the max effect of the pump governs the maximal achievable dryness for a specific washing machine. Before the bag is removed air should be let in, in order to facilitate the removal and/or opening of the bag.

The washing machine may also include an additional drying unit in order to dry the laundry 13 by the supply of dry hot air in the bag and sucking out of moist air, in the same manner as e.g. a desiccator.

The invention claimed is:

1. A washing machine for the washing of laundry such as clothes and textiles, which washing machine comprises a main part and a washing bag in which the washing of the laundry takes place, wherein the main part comprises:

an inlet, for supplying washing water, an outlet, for disposal of the washing water, a pump, for pumping air and the washing water, and a connection unit for fluid tight connection of the washing bag to the main part, wherein the washing bag has fluid tight and flexible inner walls, and a connection part located in an upper part of the washing bag for fluid tight connection to the connection unit of the main part, wherein the connection unit of the main part is arranged to lead water from the inlet of the main part to the washing bag, wherein the pump is connected to the upper part of the washing bag and arranged to:

remove the air from the washing bag to compress and soak the laundry in the washing water, and remove the washing water from the washing bag following the air removal to create a negative pressure inside the washing bag with respect to the surrounding atmospheric pressure, and wherein the negative pressure causes the flexible inner walls of the washing bag to press toward each other, thereby compressing the laundry between the flexible inner walls, wherein the flexible inner walls are provided with concavities and/or convexities.

2. The washing machine according to claim 1, wherein the washing bag has an upper part at which the connection part is arranged, and a lower part, at which the laundry is adapted to be positioned during the washing.

3. The washing machine according to claim 1, wherein the concavities and/or convexities on the inner walls are arranged to let the washing water and the air pass through the compressed laundry when the inner walls are pressed towards each other.

4. The washing machine according to claim 3, wherein the concavities and/or convexities extend along a whole extension of the inner walls.

5. The washing machine according to claim 1, wherein the washing bag comprises a separate fluid permeable inner wall that extends along at least one of the inner walls and guarantees that the inner walls do not get stuck to each other.

6. The washing machine according to claim 1, wherein the main part comprises a water container and a heating unit for storage and heating, respectively, of the washing water before it is supplied into the washing bag.

7. The washing machine according to claim 1, wherein the main part comprises an electronic equipment with which a desired washing program out of several different washing programs may be chosen, wherein the washing program's control parameters comprise washing temperature, number of soakings or water changes, and dryness.

8. The washing machine according to claim 1, wherein the walls of the washing bag comprise a heat insulating layer.

9. The washing machine according to claim 1, wherein the washing bag comprises a communication unit comprising a transponder or an RFID adapted to communicate which washing programs out of several washing programs is desired for the laundry in the washing bag to an electronic equipment of the main part.

* * * * *